US006288354B1

(12) United States Patent
Niebler et al.

(10) Patent No.: US 6,288,354 B1
(45) Date of Patent: Sep. 11, 2001

(54) SWITCHING DEVICE WITH AN ARC EXTINGUISHING DEVICE

(75) Inventors: Ludwig Niebler, Laaber; Christian Schreckinger, Kötzting, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/592,759

(22) Filed: Jun. 13, 2000

Related U.S. Application Data

(63) Continuation of application No. PCT/DE98/03650, filed on Dec. 11, 1998.

(30) Foreign Application Priority Data

Dec. 22, 1997 (DE) ..... 197 57 332

(51) Int. Cl.[7] ..... H01H 9/30

(52) U.S. Cl. ..... 218/149; 218/151; 218/156; 335/201

(58) Field of Search ..... 218/15, 16–18, 218/34–36, 149, 151, 154–7, 22; 335/8, 147, 195, 201, 202, 132

(56) References Cited

U.S. PATENT DOCUMENTS

| | | | | |
|---|---|---|---|---|
| 3,706,868 | * | 12/1972 | Rys | 218/155 |
| 4,404,442 | * | 9/1983 | Stich et al. | 218/155 |
| 4,405,847 | * | 9/1983 | Morton | 218/155 |
| 4,945,327 | * | 7/1990 | Doughty et al. | 335/201 |
| 5,589,672 | | 12/1996 | Uchida et al. . | |

FOREIGN PATENT DOCUMENTS

| | | |
|---|---|---|
| 1005592 | 4/1957 | (DE) . |
| 19663 | 8/1960 | (DE) . |
| 1885241 | 1/1964 | (DE) . |
| 1203346 | 10/1965 | (DE) . |
| 3630447A1 | 3/1988 | (DE) . |
| 1894371 | 6/1994 | (DE) . |
| 29501001.0 | 5/1995 | (DE) . |
| 0164632A2 | 12/1985 | (EP) . |
| 0217106A2 | 4/1987 | (EP) . |
| 0263293A1 | 4/1988 | (EP) . |
| 0299460A2 | 1/1989 | (EP) . |
| 0470013A1 | 2/1992 | (EP) . |
| 0556109B1 | 8/1993 | (EP) . |
| 63-292543 * | 11/1988 | (JP) . |

* cited by examiner

*Primary Examiner*—Lincoln Donovan
(74) *Attorney, Agent, or Firm*—Herbert L. Lerner; Laurence A. Greenberg; Werner H. Stemer

(57) ABSTRACT

A switching device with an arc extinguishing device includes filigree-shaped arc splitters of an arcing chamber to be mounted and fixed in an operationally reliable manner. Branches and bases of the arc splitters are kept apart by spacers, in particular by grooves formed on the outside of an arcing chamber insert.

3 Claims, 2 Drawing Sheets

SWITCHING DEVICE WITH AN ARC EXTINGUISHING DEVICE

CROSS-REFERENCE TO RELATED APPLECATION

This application is a continuation of copending International Application No. PCT/DE98/03650, filed Dec. 11, 1998, which designated the United States.

BACKGROUND OF THE INVENTION

Field of the Invention

The invention relates to a switching device including a fixed and a moving contact point and an arc extinguishing device having an arcing chamber surrounding the contact points and constructed as a pack of arc splitters stamped out in a U shape, the arc splitters being kept apart at their ends facing away from the contact points and being held together to form a subassembly.

A generic switching device having an arc extinguishing device is disclosed in European Patent EP 0 556 109 B1. In that switching device or protective device, an arc occurs at opening contact points when an electric current is being disconnected. That arc causes wear at the contact points, that is to say burning away of the contacts, and delays the disconnection of the circuit, since the current continues to flow until the arc is extinguished. The electric switching device is equipped with the arc extinguishing device in order to restrict the damage caused by the arc. That includes an arcing chamber, runner plates and diverse components which, inter alia, also fulfill flow-related tasks.

In that case, the arcing chamber is a pack of arc splitters which are stamped out in a U shape, are disposed in parallel and kept apart. Runner plates are disposed at the upper and lower ends of the arcing chamber. The fixed contact point is connected to the upper runner plate.

The above-described arc extinguishing device functions in the following way: when the contact point is opened, an arc occurs between the contact points moving away from each other. That arc is moved outward in the direction of the arcing chamber by electromagnetic forces. In the process, arc root points migrate away from the contact points along the runner plates that are electrically connected to the circuit. Once the arc reaches the arc splitters, it is subdivided into partial arcs and cooled down by the arc splitters. That leads to the partial arcs being extinguished and to the current flow being stopped.

The electromagnetic forces which move the arc away from the contact points toward the arcing chamber become greater with increasing length of the branches and bases of the arc splitters, that is to say with a more pronounced the U shape of the arc splitters. Long bases, in particular in the case of filigree layouts of arc splitters, entail problems in fixing the arc splitters. In that case, it is not possible to rule out the branches or bases or base tips of the arc splitters coming into contact with one another and welding together.

SUMMARY OF THE INVENTION

It is accordingly an object of the invention to provide a switching device with an arc extinguishing device, which overcomes the hereinafore-mentioned disadvantages of the heretofore-known devices of this general type and in which even filigree layouts of arc splitters combined in a subassembly can be mounted and fixed in an operationally reliable manner without additional outlay.

With the foregoing and other objects in view there is provided, in accordance with the invention, in a switching device having a fixed contact point and a moving contact point, an arc extinguishing device, comprising an arcing chamber surrounding the contact points, the arcing chamber having a pack of arc splitters stamped out in a U shape, the arc splitters held together to form a subassembly and having branches, bases and spaced-apart ends facing away from the contact points; an arcing chamber insert separating the moving and fixed contact points from the branches of the arc splitters; and spacers integrally molded or formed on the arcing chamber insert, the spacers keeping the branches and bases of the arc splitters spaced apart in the vicinity of the contact points.

In accordance with another feature of the invention, the arcing chamber insert has an outer surface, and the spacers are grooves formed in or integrally molded in the outer surface of the arcing chamber insert for form-lockingly receiving the branches of the arc splitters.

In accordance with a concomitant feature of the invention, there is provided an insulating strip surrounding the ends of the arc splitters facing away from the contact points, keeping the arc splitters apart and holding the arc splitters together to form the subassembly.

Other features which are considered as characteristic for the invention are set forth in the appended claims.

Although the invention is illustrated and described herein as embodied in a switching device with an arc extinguishing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
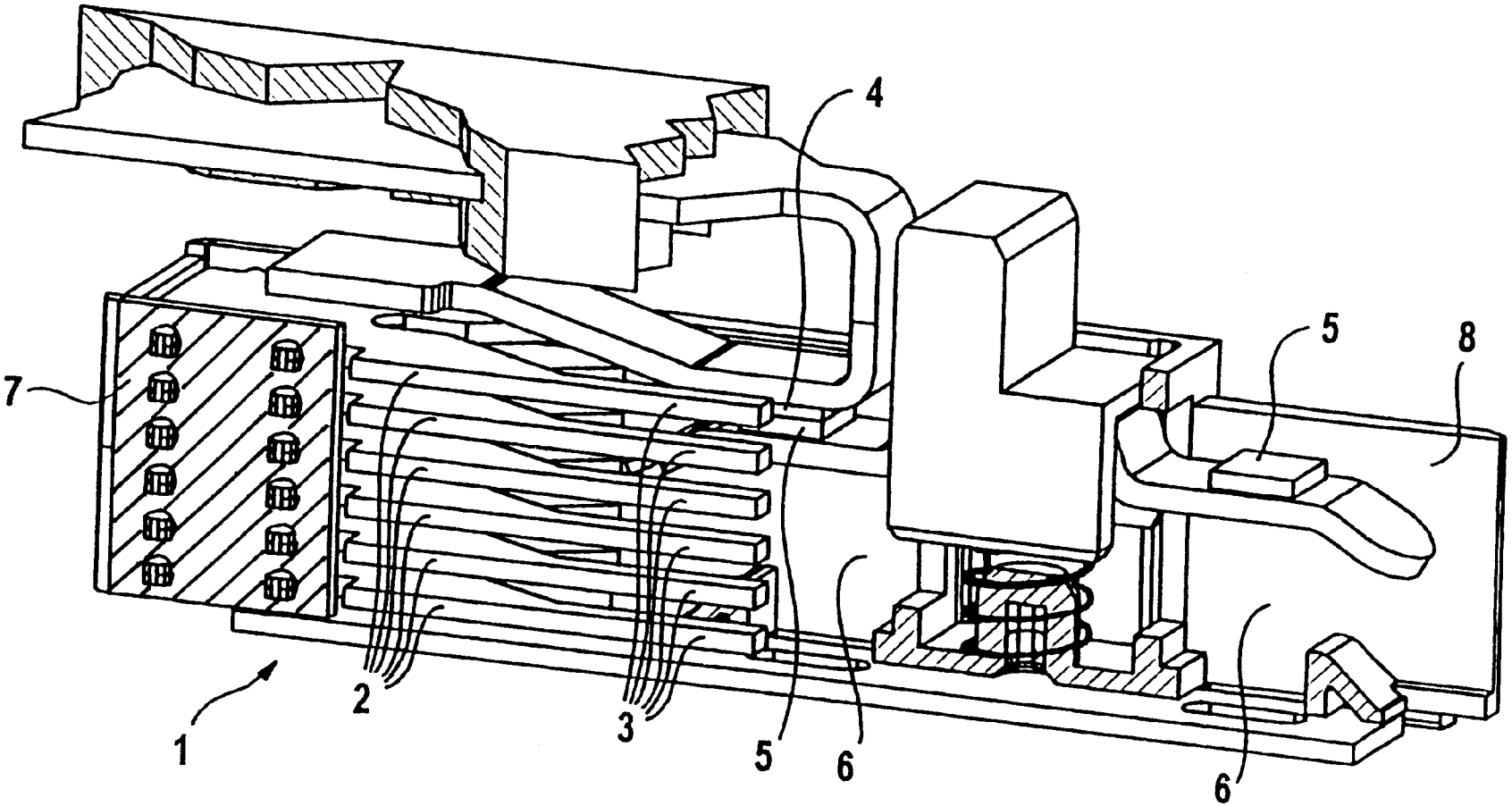
FIG. 1 is a diagrammatic, perspective view of an arc extinguishing device according to the invention with an arcing chamber insert partly broken-away.

Referring now to the figures of the drawings in detail and first, particularly, to FIG. 1 thereof, there is seen an arc extinguishing device of a switching device, which in this case essentially includes an arcing chamber 1 formed of a plurality of arc splitters or plates 2 stamped out in a U shape and assembled to form a pack. Branches and bases 3 of the arc splitters 2 surround a fixed contact point 4 and a moving contact point 5 of the switching device. The two contact points 4 and 5 are located in an internal space formed and shielded by an arcing chamber insert 6. The bases and branches 3 are separated from the contact points 4 and 5 by walls 8 of the arcing chamber insert. An insulating strip 7 is folded around ends of the arc splitters 2 which face away from the contact points 4, 5. The insulating strip 7 keeps the arc splitters 2 apart and at the same time holds them together to form a subassembly.

Figure 2:
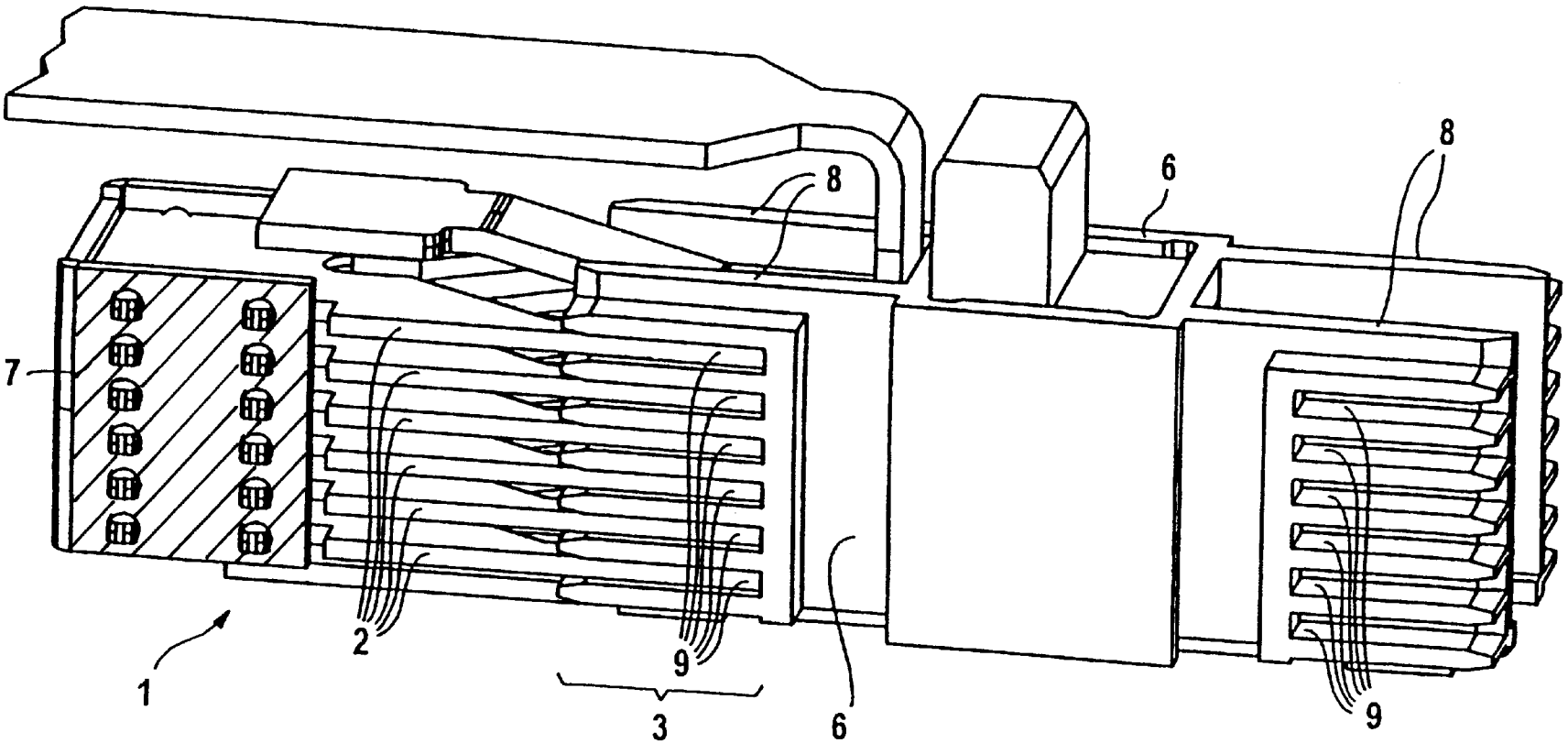
FIG. 2 is a perspective view of the arc extinguishing device according to FIG. 1 with arc splitters fixed to the arcing chamber insert.

FIG. 2 shows the arc extinguishing device, in which grooves 9 are formed in an outer surface of the walls 8 of the arcing chamber insert 6. The branches and bases 3 of the arc splitters 2 are form-lockingly inserted into the grooves 9 which form spacers. A form-locking connection is one which connects two elements together due to the shape of the elements themselves, as opposed to a force-locking connection, which locks the elements together by force external to the elements.

We claim:

1. In a switching device having a fixed contact point and a moving contact point, an arc extinguishing device, comprising:

an arcing chamber surrounding the contact points, said arcing chamber having a pack of arc splitters stamped out in a U shape, said arc splitters held together to form a subassembly and having branches, bases and spaced-apart ends facing away from the contact points;

an arcing chamber insert separating the moving and fixed contact points from said branches of said arc splitters; and spacers formed on said arcing chamber insert, said spacers keeping said branches and bases of said arc splitters spaced apart in the vicinity of the contact points.

2. The switching device according to claim 1, wherein said arcing chamber insert has an outer surface, and said spacers are grooves formed in said outer surface of said arcing chamber insert for form-lockingly receiving said branches of said arc splitters.

3. The switching device according to claim 1, including an insulating strip surrounding said ends of said arc splitters facing away from the contact points, keeping said arc splitters apart and holding said arc splitters together to form said subassembly.

* * * * *